United States Patent [19]

Clifford

[11] 3,950,110

[45] Apr. 13, 1976

[54] NON-CIRCULAR COMPACTION ROLLER, AND A MOUNTING THEREFOR

[75] Inventor: John Michael Clifford, Pretoria, South Africa

[73] Assignee: South African Inventions Development Corporation, Pretoria, South Africa

[22] Filed: Apr. 16, 1975

[21] Appl. No.: 568,452

[30] Foreign Application Priority Data

Apr. 19, 1974 South Africa ..... 74/2502

[52] U.S. Cl. ..... 404/124; 172/417

[51] Int. Cl.[2] ..... E01C 19/26

[58] Field of Search ..... 404/128, 124, 122; 280/43.22; 172/240, 238, 324, 400, 417, 422

[56] References Cited

UNITED STATES PATENTS

| | | | |
|---|---|---|---|
| 2,909,106 | 10/1959 | Berrange | 404/124 |
| 3,094,315 | 6/1963 | Yetter | 404/124 X |
| 3,260,179 | 7/1966 | Moreira | 404/128 |
| 3,316,822 | 5/1967 | Seaman | 404/128 |
| 3,554,295 | 1/1971 | Kopaska | 172/417 X |
| 3,588,139 | 6/1971 | Bayne | 172/417 X |
| 3,627,059 | 12/1971 | Jackson | 172/417 X |

*Primary Examiner*—Nile C. Byers
*Attorney, Agent, or Firm*—Karl W. Flocks

[57] ABSTRACT

A compaction assembly comprising a lobed roller and a draw frame; and the operation thereof. A pair of composite links interconnects the roller and frame, each being pivotally connected to the frame and comprising at least two constituent links pivotally interconnected, all of said pivotal connections having lateral axes. Bearing means on each composite link carries the roller which extends therebetween. The composite links act as guide means constraining and guiding rolling of the roller. The bearing means are mounted to be independently pivotable about two or more axes relative to the draw frame and so that the roller axis has vertical free movement subject to gravity. Bias means biasses constituent links of the composite links into positions inclined to each other and allows the roller axis resiliently damped free movement relative to the frame in opposite directions along the direction of rolling.

10 Claims, 3 Drawing Figures

NON-CIRCULAR COMPACTION ROLLER, AND A MOUNTING THEREFOR

This invention relates to a compaction roller assembly, and it relates to a method of operating such assembly.

According to the invention, a compaction roller assembly includes:

a draw frame;

a non-circular lobed compaction roller;

guide means for rotatably guiding the rolling of the roller about its axis to follow the draw frame and comprising a pair of laterally spaced longitudinally extending composite links on either side of the roller and pivotally connected to the draw frame about primary pivotal axes extending laterally, each composite link comprising at least two constituent links pivotally connected together about secondary pivotal axes parallel to the primary pivotal axes, bias means to bias at least two of the constituent links of each composite link resiliently into positions in which they are at an angle to one another, and bearings for the roller on each of the composite links rotatably mounting the roller about its axis, the guide means permitting arcuate displacement of the roller axis independently about the primary and secondary pivotal axes.

In this specification the words 'laterally' and 'longitudinally' refer to the fore and aft direction of the draw frame, 'longitudinally' being parallel thereto and 'laterally' having a corresponding meaning. 'Independently' with reference to the arcuate displaceability of the roller axis about the primary and secondary axes means that the bearings and the roller axis are displaceable relative to the draw frame about the primary pivotal axes without necessarily being arcuately displaceable about the secondary pivotal axes, and vice versa.

The composite links may be trailing links, each composite link comprising two constituent links, namely a front constituent link pivotally connected to the frame about one of the primary pivotal axes, and a rear constituent link pivotally connected to the front constituent link about one of the secondary pivotal axes, the bearings for the roller being provided on the rear constituent links.

The bias means may comprise at least one torsion bar connected to the frame and substantially parallel to the rotational axis of the roller, whereby each of the composite links is conneced to the roller via one of its constituent links. The assembly may include two torsion bars, one of the two composite links being connected to the frame via one of the two torsion bars, and the other of the two composite links being connected to the other of the two torsion bars, and the torsion bars having their axes parallel and closely spaced from each other.

The frame may have at least one pair of wheels spaced laterally on opposite sides of the roller, the wheels acting to support the frame. The wheels may be mounted on a pair of trailing arms forming part of the frame, spaced laterally on opposite sides of the roller.

The assembly may include raising means for raising the roller relative to the frame from an operative position in which it can roll on the ground to an inoperative position in which it is supported by the frame clear of the ground. The raising means may comprise a pair of hydraulic plunger and cylinder assemblies mounted in laterally spaced positions on opposite sides of the frame, the plunger and cylinder assemblies being telescopically extensible to bear upwardly against abutments connected to opposite sides of the roller, thereby to raise the roller to its inoperative position.

The invention extends to a method of operating a compaction roller assembly which comprises a non-circular lobed compaction roller and a draw frame to which the roller is attached, the method commprising attaching the roller to the draw frame in such a manner that when it rolls in operation:

the axis of the roller has freedom of movement in a direction at right angles to itself, subject to gravity, along an upwardly extending path or paths determined by the attachment of the roller to the draw frame;

the said axis has resiliently damped freedom of movement in opposite directions along the direction of rolling; and it is constrained laterally by laterally spaced guide means to follow a path determined by the draw frame.

The invention will now be described by way of example, with reference to the accompanying drawings.

Figure 1:
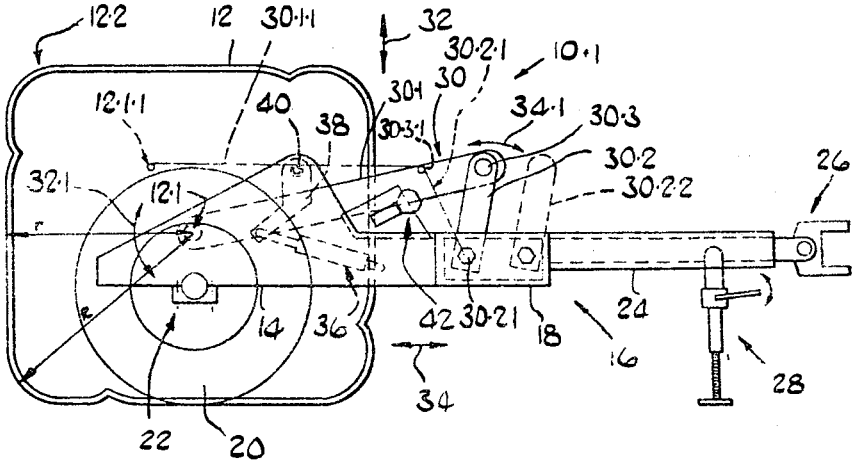
FIG. 1 shows a diagrammatic side elevation of a compaction roller assembly having a multi-lobed non-circular compaction roller mounted according to one embodiment of the invention.

Referring particularly to FIG. 1 of the drawings, reference numeral 10.1 refers generally to a compaction roller assembly comprising a multi-lobed non-circular compaction roller 12 having a rotational axis 12.1 and lobes 12.2 mounted rotatably between laterally spaced trailing arms 14 on a draw frame, generally indicated by reference numeral 16. The frame 16 comprises generally a transverse member 18 extending parallel to the rotational axis 12.1 of the roller. From positions at or near the ends of the transverse member 18 the arms 14 extend rearwardly on opposite sides of the roller 12. At the trailing ends of the arms 14 there are provided wheels 20 rotatably mounted in bearings 22 secured to the arms 14.

At the middle of the transverse member 18, and extending forwardly, there is provided a tongue-like projection 24 at the front end of which there is provided connection means 26 for connection to a draft vehicle. Also provided at the front end of the projection 24, is a foldable or removable supporting jack 28 for supporting the projection 24 while the roller 12 is not in use.

The mounting of the roller 12 within the frame 16 is by means of a pair of trailing composite links 30 pivotally connected to the frame about primary axes 30.21. This mounting permits freedom of movement of the axis 12.1 of the roller 12 while it is rolling in operation relative to the frame 16 in the direction of arrows 32 and 34.

Each composite link 30 comprises constituent links, namely a rear link 30.1 and a front link 30.2 pivotally connected together about a secondary axis 30.3 parallel to the rotational axis 12.1 of the roller. The front link 30.2 is pivotally connected at its lower end about the primary axis 30.21 to the frame, and extends upwardly therefrom. The link 30.2 is biassed to a position inclined at an angle to and non-aligned with link 30.1 by means of a torsion bar co-axial with and defining the primary lower pivotal axis 30.21. The roller 12 is mounted to rotate about its axis 12.1 in bearing means (not shown) in the trailing ends of the links 30.1.

The torsion bar (not shown) is supported pivotally at one end adjacent its connection to the link 30.2 by the frame 16 and is held fast at its opposing end, also by the frame 16.

The composite link 30 has been described for one side of the roller 12. It will be understood that a similar construction of composite link with torsion bar is provided for the other side of the roller 12, the torsion bars of the composite links being parallel and closely spaced from each other. Thus, the link 30.2.2 forms part of the other composite link and corresponds in function with the link 30.2 of the composite link 30. It will be noted, however, that the link 30.2.2 is mounted slightly spaced from the link 30.2. This is to ensure that a maximum length of torsion bar can be utilized. If the torsion bars are mounted co-axially, then a torsion bar only about half the length would otherwise be possible to be utilized. For clarity of the drawings, the spacing between the links 30.2 and 30.2.2 in a fore and aft direction is exaggerated.

The assembly 10.1 further includes raising means, indicated by reference numeral 36, which comprises a pair of hydraulically operable plunger and cylinder assemblies, one assembly mounted in each arm 14 and co-acting with a lever 38 mounted on the frame and pivotable about a pin having its axis parallel to the axis 12.1 and located at 40. This raising means is adapted to raise the roller 12 into such a position that its lobes 12.2 are out of contact with the ground so that the roller may be transported in its frame, which is itself supported by the wheels 20. In this transporting position the axis 12.1 of the roller 12 will occupy more or less the position 12.1.1. The centre line of the link 30.1 will occupy more or less the position 30.1.1, and the centre line of the link 30.2 will occupy more or less the position 30.2.1, and the pivotal axis 30.3 will occupy more or less the position 30.3.1. The assemblies 36 are extensible to bear upwardly against abutments (not shown) on the links 30.1 to raise the roller.

In operation a draught vehicle will be attached to the impact roller assembly at the connection means 26 which is in the form of a universal coupling. When the assembly starts moving, the axis 12.1 of the roller will move in an up and down fashion, the movement in a vertical direction of the axis 12.1 being determined by the difference between the maximum and minimum radii of the roller, namely R and *r*. In operation, freedom of movement, subject to gravity, of the roller 12 relative to the frame 16, is permitted along an upwardly extending path by the arcuate movement of the trailing ends of the links 30.1 rotatably supporting the axis 12.1 of the roller in the direction of arrow 32.1 about the axis 30.3. The arcuate movement in the direction of arrow 32.1 of the trailing end of these links provides the vertical movement 32 referred to above. Likewise, horizontal movement backwards and forwards, as indicated by arrow 34, of the axis 12.1 of the roller relative to the frame 16, is provided by the arcuate movement in the direction of arrow 34.1 of the secondary pivotal axes 30.3 at the upper ends of the links 30.2 when the links 30.2 pivot in resiliently damped fashion about the primary axes 30.21 of the torsion bar relative to the frame. When the roller 12 is pulled by the frame 16, the composite links 30 act as guide means whereby the roller is guided along the path of the frame. The torsion bars act resiliently to damp freedom of movement of the roller in opposite directions relative to the frame along the direction of rolling shown by arrow 34.

A buffer stop 42 is provided on each arm 14 for abutting against the links 30.2 to prevent constituent links 30.1 and 30.2 from becoming aligned parallel and end-to-end. The stops also prevent overstraining of the torsion bars.

Figure 2:
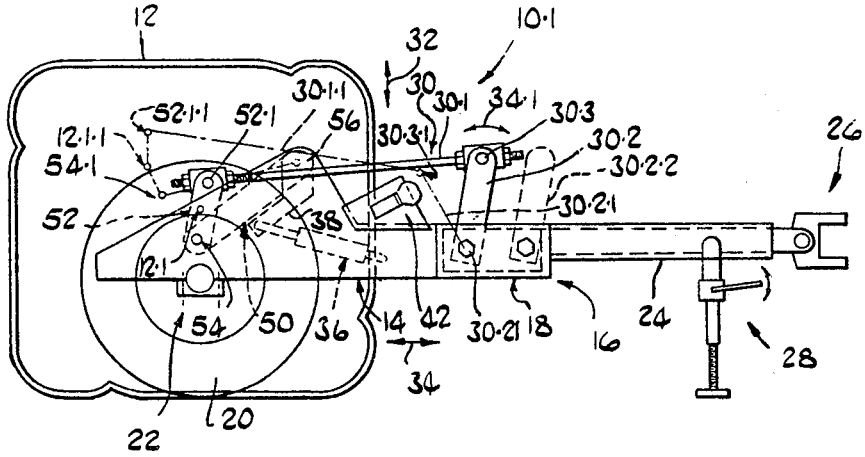
FIG. 2 shows a diagrammatic side elevation of a compaction roller assembly having a multi-lobed non-circular compaction roller, mounted in accordance with another embodiment of the invention.

Referring now to FIG. 2 of the drawings, the construction is generally the same as that shown in FIG. 1. Like reference numerals refer to like parts. The main difference between the embodiment of FIG. 2 from that shown in FIG. 1, is that while lateral guidance of the roller 12 relative to the frame 16 in FIG. 1 is taken care of by the pair of laterally spaced composite links 30 alone, the lateral guidance is provided in FIG. 2 also by auxiliary links 50 and 52 pivotally connected together about the axis 54 of a pin, the axis 54 being parallel to the rotational axis 12.1 of the roller, which axis 12.1 is rotatably supported in bearings carried by links 52. The leading end of the link 50 is pivotally connected about an axis 56 in the arm 14 of the frame, the axis 56 being parallel to the rotational axis 12.1 of the roller. The link 30.1 is pivotally connected to the link 52 about an axis 52.1 which is spaced from but parallel to the axis 12.1 of the roller which is connected to the link 52. Thus, the roller 12 is connected swingletree fashion to the frame 16 via the link 52 and via connecting links 50, 30.1, and 30.2, and the torsion bar having its axis co-axial with axis 30.21. A similar linking arrangement is provided on the other side of the roller. It is to be noted that, in FIG. 2, the axis 12.1, for clarity of illustration, is shown somewhat above its actual position.

In the embodiment of FIG.2 of the roller assembly also, there is provided raising means 36 for raising the roller 12 for transport purposes so that it is clear of the ground surface when supported by the frame 16 when supported by its wheel 20. When the roller 12 is in its raised position, its rotational axis 12.1 then occupies the position indicated by reference numeral 12.1.1, the pivotal axis 54 occupies the position 54.1, and the pivotal axis 52.1 occupies the position 52.1.1. The positions of the links 30.1 and 30.2 are as indicated by reference numerals 30.1.1 and 30.2.1, similarly as for the embodiment of FIG. 1.

In operation, the embodiment of FIG. 2 operates in very much the same way as the embodiment of FIG. 1 except that for lateral guidance of the roller 12 within the frame 16, reliance is now placed upon the links 50 and 52 which, being shorter, can be strong and robust to resist the bending forces imposed upon them by the heavy roller 12 during operation when turning. The composite links 30 act as guide means to guide the roller 12, and the links 50 and 52 thus serve as additional guide means.

In operation, the rotational axis 12.1 of the roller 12 should preferably not rise above the elevation of the pivotal axis 56 of the links 50 in the arms 14.

The buffer stop 42 in the embodiment of FIG. 2 also serves to prevent the constituent links 30.1 and 30.2 from becoming aligned parallel and end-to-end. They also serve to prevent overloading of the torsion bars.

If desired, the elevation of the pivotal axis 30.3 may be at about the same elevation as the axis 12.1 of the roller 12 when the roller is lying in the position shown in FIGS. 1 and 2. Likewise, the axis 52.1 may be coincident with the roller axis 12.1. The result of this is that the link 30.1 will be more or less horizontal in FIGS. 1 and 2. This may be achieved by shortening the link 30.2 or by lowering its lower pivotal axis 30.21.

The mean operating position of the link 30.2 may be such that the long axis of the link is substantially vertical.

For ease of operation, the rotational axis of the wheels 22 should lie near to the vertical plane through the rotational axis 12.1 of the roller.

For added strength and rigidity of the frame 16, the arms 14 may be extended, if desired, rearwardly past the rear of the roller 12, where they are interconnected by a cross member (not shown).

Figure 3:
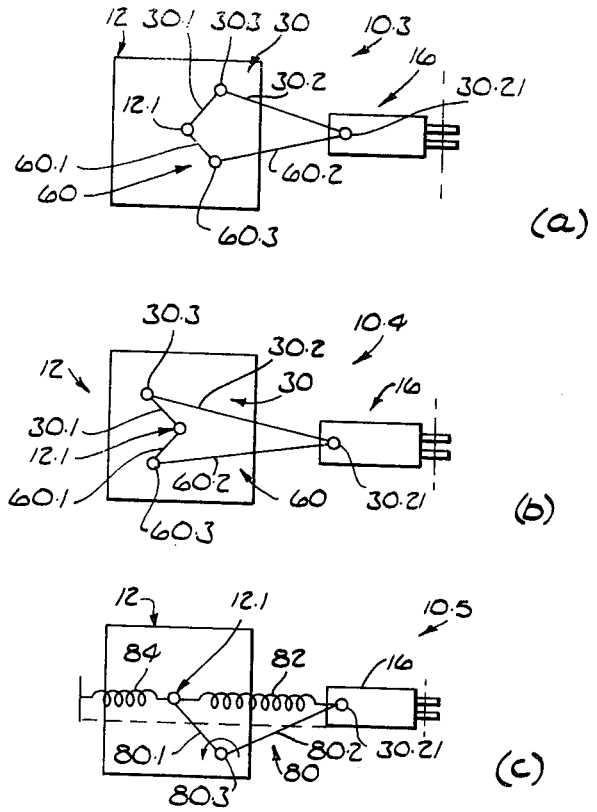
FIG. 3 shows diagrammatic side views of three further embodiments.

Referring now to FIG. 3 of the drawings, there are shown three further variations in diagrammatic side view, of rollers embodying the invention.

In the embodiment of FIG. 3*a*, the roller 12 is connected to the frame 16 by means of two pairs of laterally spaced composite links 30, 60, one pair of composite links 30, 60 being on one side of the roller, and the other pair on the other side. One link of each pair 30, 60 is pivotally connected at its leading end to a torsion bar having its axis coincident or closely spaced from and parallel to the axis 30.21, the other being freely pivoted at said axis. Instead, spring members (not shown) may be provided at the joints 30.3 or 60.3 to bias the constituent links 30.1 and 30.2, and 60.1 and 60.2 to the non-aligned position shown, both links of each pair 30, 60 being freely pivoted at or adjacent said axis 30.21.

The embodiment of FIG. 3*b* is similar in construction and operation to that of FIG. 3*a*. The only difference being that the constituent links of the composite links 30 and 60 define acute angles between them instead of obtuse angles.

Referring now to FIG. 3*c*, the roller there shown may have two composite links 80 as shown, or two pairs of composite links similarly arranged to composite links 30 and 60 of FIGS. 3*a* and 3*b*. In addition, however, a spring may be provided at 82, and a spring at 84. These springs 82 and 84 may be helical or leaf springs, as desired, and serve the same purpose as the torsion bars of FIGS. 1 and 2, the links being freely pivotable at 30.21.

Freedom of movement, subject to gravity, along an upwardly extending paty, of the roller axis 12.1 at right angles to itself, and resiliently damped freedom of movement of movement of said axis at right angles to itself, in opposite directions along the direction of rolling, are together made possible by the fact that the bearing means wherein the roller 12 is mounted to rotate about its axis 12.1, are mounted on their links [30.1 in FIG. 1; 52 in FIG. 2; 30.1 and 60.1 in FIGS. 3*a* and 3*b;* and 80.1 in FIG. 3*c*]in positions spaced from the axes 30.3, 60.3 and 80.3. Said bearing means are thus pivotable relative to the frame 16 about the axes 30.3, 60.3 and 80.3 on the one hand, and on the other hand are independently pivotable relative to the frame about the axis/axes 30.21. Thus, for example, with reference to FIGS. 1 and 2, the axis 12.1 and the bearing means of the roller 12 can together pivot about the axis 30.3 (thereby providing said freedom of movement subject to gravity) without necessarily (although often) pivoting about the axis 30.21, and, on the other hand, they can together pivot about the axis 30.21 (thereby to provide the said resilient damped freedom of movement) without necessarily (although usually) pivoting about the axis 30.3. The same applies in FIG. 3 with reference to axes 30.3, 60.3 and 80.3 on the one hand, and axis 30.21 on the other. The roller axis 12.1 can thus move along a plurality of paths at right angles to itself relative to the frame 16. This is to be contrasted with the case where the roller 12 is attached to the frame via bearing means mounted on simple links pivotally connected to the frame, in which case the axis 12.1 is constrained to move along a single arcuate path relative to the frame.

An advantage of the invention is thus that, due to the freedom of movement of the roller axis 12.1 in the direction of arrow 32, shock loading on the frame, and hence shock loading on the connection means 26, caused by vertical movement of the roller axis, is reduced, while at the same time movements of the axis 12.1 relative to the frame in the direction of arrow 34, are resiliently damped. This resilient damping further serves to protect both the frame and connection at 26 against shock loading.

A consideration of the function of the composite links and bearings will show that, depending upon the condition of the surface on which the roller rolls, the guide means will also permit such movements of the roller as result in differential movements of opposite ends of the roller axis relative to each other, e.g. swivelling of the roller axis in a plane parallel to the direction of rolling and tilting of the roller axis in a plane at right angles to the direction of rolling. Thus, during rolling of the roller in use, the frame is largely protected from shock loads resulting from such variations in movement of the roller, as well as from those variations in movement of the roller described in the preceding paragraph.

I claim:

1. A compaction roller assembly which includes:

a draw frame;

a non-circular multi-lobed compaction roller;

guide means for rotatably guiding the rolling of the roller about its axis to follow the draw frame and comprising a pair of laterally spaced longitudinally extending composite links on either side of the roller and pivotally connected to the draw frame about primary pivotal axes extending laterally, each composite link comprising at least two constituent links pivotally connected together about secondary pivotal axes parallel to the primary pivotal axes, bias means to bias at least two of the constituent links of each composite link resiliently into position in which they are at an angle to one another, and bearings for the roller on each of the composite links rotatably mounting the roller about its axis, the guide means permitting arcuate displacement of the roller axis independently about the primary and secondary pivotal axes.

2. An assembly as claimed in claim 1, in which the composite links via trailing links, each composite link comprising two constituent links, namely a front constituent link pivotally connected to the frame about one of the primary pivotal axes, and a rear constituent link pivotally connected to the front constituent link about one of the secondary pivotal axes, the bearings for the roller being provided on the rear constituent links.

3. An assembly as claimed in claim 1, in which the biassing means comprises at lease one torsion bar connected to the frame and substantially parallel to the rotational axis of the roller, whereby each of the composite links is connected to the roller via one of its constituent links.

4. An assembly as claimed in claim 3, which includes two torsion bars, one of the two composite links being connected to the frame via one of the two torsion bars, and the other of the two composite links being connected to the other of the two torsion bars, and the torsion bars having their axes parallel and closely spaced from each other.

5. An assembly as claimed in claim 1, in which the frame has at least one pair of wheels spaced laterally on opposite sides of the roller, the wheels acting to support the frame.

6. An assembly as claimed in claim 5, in which the wheels are mounted on a pair of trailing arms, forming part of the frame, spaced laterally on opposite sides of the roller.

7. An assembly as claimed in claim 1, which includes raising means for raising the roller relative to the frame from an operative position in which it can roll on the ground to an inoperative position in which it is supported by the frame clear of the ground.

8. An assembly as claimed in claim 7, in which the raising means comprises a pair of hydraulic plunger and cylinder assemblies mounted in laterally spaced positions on opposite sides of the frame, the plunger and cylinder assemblies being telescopically extensible to bear upwardly against abutments connected to opposite sides of the roller, thereby to raise the roller to its inoperative position.

9. An assembly as claimed in claim 1, in which:

the guide means includes first and second auxiliary links pivotally connected together about an auxiliary link axis parallel to the primary and secondary pivotal axes;

the first auxiliary link being also pivotally connected to the frame about an axis parallel to the primary and secondary pivotal axes; and the second auxiliary link being pivotally connected to the composite link and also carrying the bearings for the roller.

10. An assembly as claimed in claim 9, in which the mounting of the bearings for the roller is between the pivotal connections connecting the second auxiliary link to the first auxiliary link and to the composite link.

* * * * *

UNITED STATES PATENT OFFICE

CERTIFICATE OF CORRECTION

Patent No. 3,950,110 Dated April 13, 1976

Inventor(s) JOHN MICHAEL CLIFFORD

It is certified that error appears in the above-identified patent and that said Letters Patent are hereby corrected as shown below:

Column 7, Claim 3, line 2, change "lease" to --least--.

line 5, change "roller" to --frame--.

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*